US005156854A

United States Patent [19]

Yamada

[11] Patent Number: 5,156,854

[45] Date of Patent: Oct. 20, 1992

[54] PRESS FORMING APPARATUS FOR SINTERED PARTS

[75] Inventor: Masao Yamada, Chiba, Japan

[73] Assignee: Hitachi Powdered Metals Co., Ltd., Chiba, Japan

[21] Appl. No.: 828,162

[22] Filed: Jan. 30, 1992

[30] Foreign Application Priority Data

Jan. 31, 1991 [JP] Japan ..... 3-31668

[51] Int. Cl.[5] ..... B22F 3/00

[52] U.S. Cl. ..... 425/78; 425/352; 425/354; 425/406; 425/412

[58] Field of Search ..... 425/78, 352, 354, 355, 425/406, 412, 414, 422, 444

[56] References Cited

U.S. PATENT DOCUMENTS

| | | | |
|---|---|---|---|
| 2,254,107 | 8/1941 | Miller et al. | 425/352 |
| 2,509,783 | 5/1950 | Richardson | 425/78 |
| 3,132,379 | 5/1964 | Crane | 425/78 |
| 3,868,201 | 2/1975 | Jacobson et al. | 425/406 |
| 4,153,399 | 5/1979 | DeSantis | 425/414 |
| 4,392,800 | 7/1983 | Apuzzo | 425/355 |

FOREIGN PATENT DOCUMENTS

| | | | |
|---|---|---|---|
| 61-232019 | 10/1986 | Japan . | |
| 61-232020 | 10/1986 | Japan | 425/78 |
| 261001 | 3/1990 | Japan . | |
| 846111 | 7/1981 | U.S.S.R. | 425/78 |

OTHER PUBLICATIONS

English abstract of Japanese Laid-Open Patent No. 61-232019.

English abstract of Japanese Laid-Open Patent No. 2-61001.

*Primary Examiner*—Jay H. Woo

*Assistant Examiner*—Scott Bushey

*Attorney, Agent, or Firm*—Sandler, Greenblum & Bernstein

[57] ABSTRACT

In a press forming apparatus for forming spiral parts, a plurality of first connecting rods are mounted on a lower end of a divided core divided from a die in shifting relation to each other in a winding direction of vortex. The plurality of first connecting rods are supported by a vertically movable core plate, while a plurality of second connecting rods are mounted on a lower end of a lower punch in shifting in position relation to each other. The second connecting rods extend respectively through bores in the core plate, and are supported by a lower punch plate movable vertically and arranged below the core plate. Further, the first and second connecting rods extend through a stationary block. The stationary block is arranged between the die and the core plate, for restricting downward movement of the lower punch and the divided core.

1 Claim, 3 Drawing Sheets

PRESS FORMING APPARATUS FOR SINTERED PARTS

BACKGROUND OF THE INVENTION

The present invention relates particularly to a press forming apparatus for sintered parts, which is suitable for producing spiral sintered parts.

A press forming apparatus for producing spiral parts such as an impeller used in a pump, a rotor for a compressor, and the like, is arranged, for example, such that a spiral mold cavity is formed in a die that is an outer mold, so as to extend vertically through the die, and a lower punch is fitted in the mold cavity so as to be movable vertically, while a vertically movable upper punch is arranged above the die. The arrangement is such that spiral compacts are formed by compression due to the upper and lower punches. In this compression. a withdrawal type is also utilized in which the lower punch is fixed, while the die is movable vertically.

Since the die is formed therein with the spiral mold cavity, the aforesaid conventional apparatus is left under a unsteady condition in which its center is insufficient in rigidity. For this reason, deformation occurs at compressive forming or molding and when a compact is withdrawn so that there is a fear that the press forming apparatus is broken and cracks are developed in the compact.

As a remedy for the above, an arrangement is known as is described in Japanese Patent Laid-Open No. SHO 61-232019, in which each of core sections located respectively between vortexes of the mold cavity is divided from the die, and the divided core is supported from the below by a plurality of rods. An arrangement is also known as is described in Japanese Patent Laid-Open No. HEI 2-61001, in which an auxiliary element is provided out of a forming range of a die having a spiral mold cavity to reinforce the die, and a lower punch is supported from the below and is provided with slots so as not to interfere with the reinforcing element.

However, since the former arrangement is of construction in which the divided core is supported through a plurality of rods by a core plate which is located below a lower punch receiving plate, the plurality of rods receive a pressure of compressive forming so that it is difficult to produce high density compacts.

The same is applicable also to the latter arrangement. Since at least two slots are formed in the lower punch, strength is low so that the arrangement is easy to be broken. Thus, it is difficult to produce high density compacts.

SUMMARY OF THE INVENTION

The invention dissolves the above-discussed problems, and it is an object of the invention to provide a press forming apparatus for forming spiral sintered parts, which is utilizable in a general press forming apparatus, which can produce high density compacts stably, and which is simple in construction.

In order to achieve the above-described object, according to the invention, there is provided a press forming apparatus for manufacturing spiral sintered parts, the press forming apparatus comprising:

a die serving as an outer mold and having an opening at a center;

a divided core inserted into said opening, having a spiral mold cavity which extends vertically through said divided core;

an upper punch arranged above said die and movable vertically;

a lower punch arranged below said die, having a spiral configuration fitted in said mold cavity, cooperating with said die and said divided core to define a cavity into which powder is filled;

a plurality of first connecting rods extending in a press direction, arranged in a periphery direction of said divided core, being connected to a lower end of said divided core;

a core plate supporting lower ends of said plurality of first connecting rods, having through bores extending in the press direction;

a first vertical drive unit vertically driving said core plate;

a plurality of second connecting rods and extending in the press direction through the through bores in said core plate, being arranged in a spiral direction of said lower punch, being connected to a lower end of said lower punch;

a lower punch plate arranged below said core plate, supporting lower ends of the plurality of second connecting rods;

a second vertical drive unit vertically driving said lower punch plate; and a stationary block arranged between said die and said core plate, having a plurality of through bores through which said plurality of first and second connecting rods extend, restricting downward movement of said lower punch and said divided core.

With the arrangement of the invention, the divided core having the spiral mold cavity and the lower punch fitted in the mold cavity can be supported on their respective plates through the plurality of connecting rods, and rigidity of each of the divided core and the lower punch can be secured so that deformation and breakage are eliminated. Further, since a construction is utilized in which, at compressive forming, the divided core and the lower punch are abutted against a stationary block to restrict downward movement of the divided core and the lower punch, a high pressure is not applied to each of the plurality of connecting rods, so that there is no fear that each of the rods is deformed and broken. Thus, it is possible to produce a high density compact stably.

DETAILED DESCRIPTION OF THE PREFFERRED EMBODIMENT

An embodiment of the invention will hereunder be described with reference to FIGS. 1 through 4.

Figure 1:
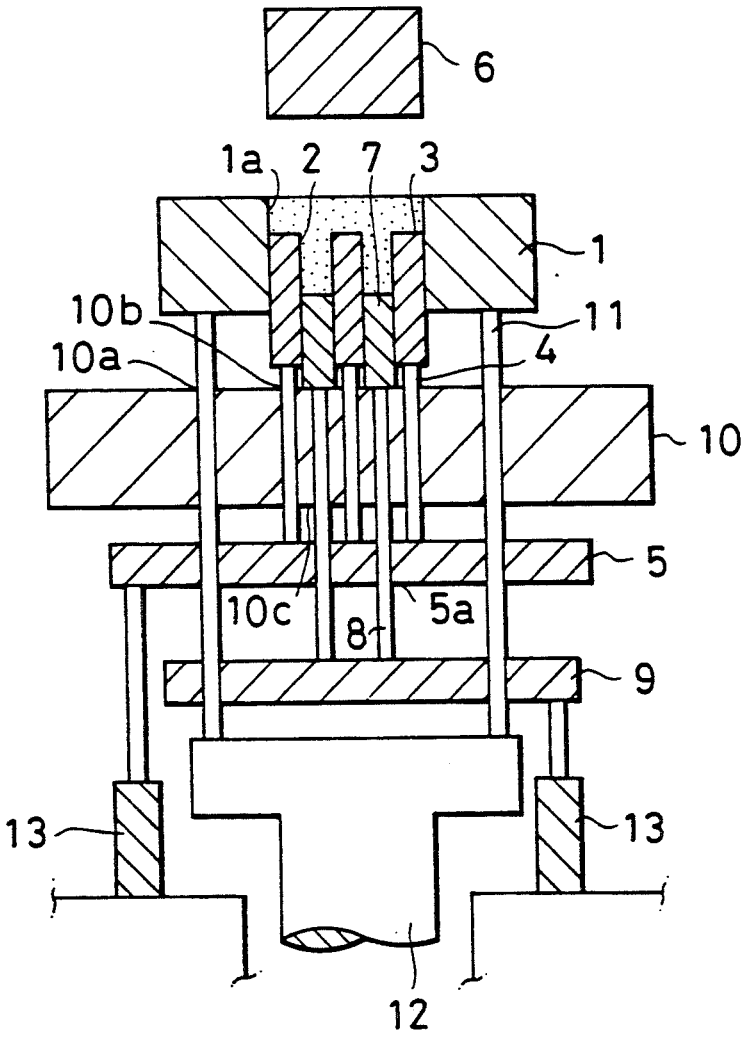
FIG. 1 is a cross-sectional view showing a press forming apparatus according to an embodiment of the invention under a condition that powder is filled up.

As shown in FIG. 1 which is a longitudinal cross-sectional view showing a principal portion of the invention, a press forming apparatus according to the embodiment comprises a die 1 movable vertically, a divided core 3 divided from the die 1 and having a mold cavity 2, a core plate 5 supporting the divided core 3 through connecting rods 4, upper and lower punches 6 and 7 movable vertically, a lower punch plate 9 arranged below the core plate 5 and supporting the lower punch 7 through connecting rods 8, a fixed or stationary block 10 for limiting or restricting downward movement of the lower punch 7 and the divided core 3, and the like.

The die 1 is arranged such that a through cut-off bore 1*a* is located at a center. The die 1 is fixedly supported by a lower ram 12 of a press body through connecting rods 11 which extend downwardly from a lower end-face of the die 1, and is moved vertically in interlocking relation to the lower ram 12. The stationary block 10 mounted adjacent to a body of the press is arranged below the die 1. Through bores 10*a*, 10*b* and 10*c* are formed in the stationary block 10, and the connecting rods 11, the connecting rods 4 of the divided core 3 and the connecting rods 8 of the lower punch 7 extend through the through bores 10*a*, 10*b* and 10*c*, respectively.

Figure 4:
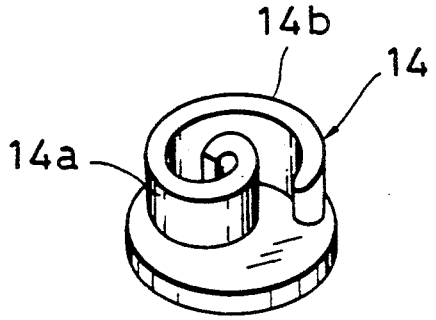
FIG. 4 is a perspective view showing the compact produced by the embodiment.

The divided core 3, which is separately formed correspondingly to the cut-off bores 1*a*, has the spiral mold cavity 2 which forms a spiral side wall 14*a* of a compact 14 illustrated in FIG. 4. The divided core 3 has a lower end-face on which the plurality of connecting rods 4 are mounted with their respective positions shifting from each other. These connecting rods 4 extend respectively through the through bores 10*b* in the stationary block 10 and is supported by the core plate 5. The core plate 5 is moved vertically by a vertical drive unit 13 such as a hydraulic cylinder or the like which is arranged adjacent to the body of the press, whereby the divided core 3 is moved vertically.

The lower punch 7 is formed into a spiral shape or configuration which is fitted in the mold cavity 2 to form a spiral end face 14*b* of the compact 14. The lower punch 7 has a lower end-face on which the plurality of connecting rods 8 are mounted with their respective positions shifting from each other. These connecting rods 8 extend respectively through the through bores 10*c* and the through bores 5*a* formed in the core plate 5. The connecting rods 8 are supported by the lower punch plate 9. The lower punch plate 9 is moved vertically by the vertical drive unit 13 similarly to the core plate 5, whereby the lower punch 7 is moved vertically.

The lower punch plate 9 and the core plate 5 are detected in their respective positions by a position sensor (not shown), and are restricted in stop position by the vertical drive unit 13. Further, when the lower end-faces of the respective divided core 3 and lower punch 7 are abutted against the stationary block 10, downward movement of each of the plates 5 and 9 is restricted.

In connection with the above, in the embodiment, the divided core 3 and the lower punch 7 are formed such that each of them is integral. However, the arrangement may be such that each of the divided core 3 and the lower punch 7 is divided in the winding direction of the spiral or vortex and is formed by a plurality of elements, and the divided elements are integrally supported through the connecting rods 4, connecting rods 8 or the like.

Figure 2:
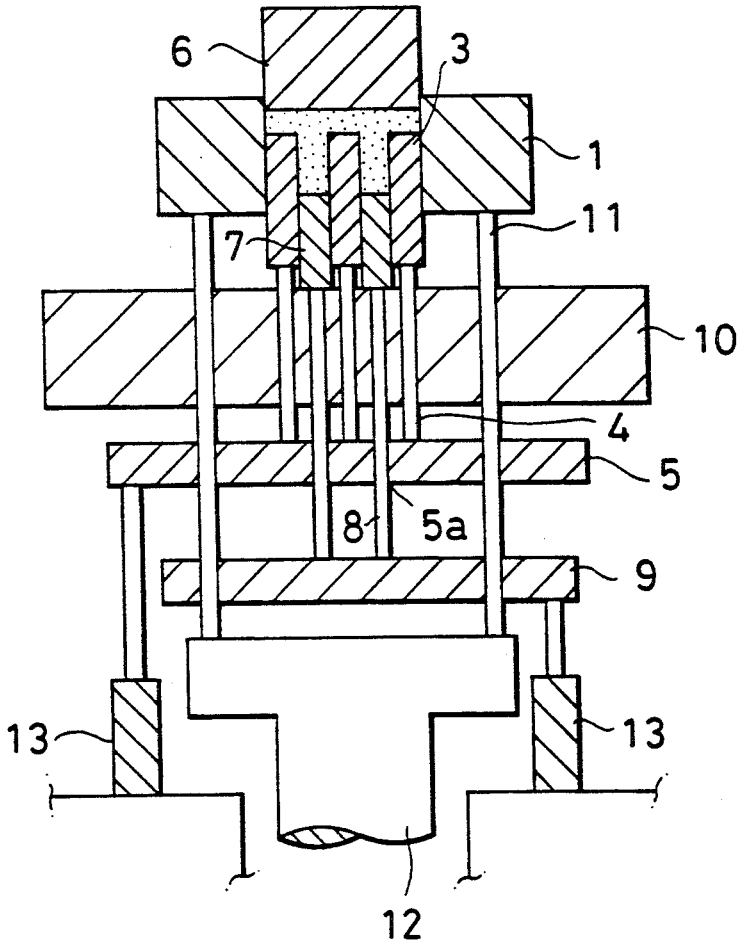
FIG. 2 is a cross-sectional view showing the press forming apparatus under a condition at compression.
Figure 3:
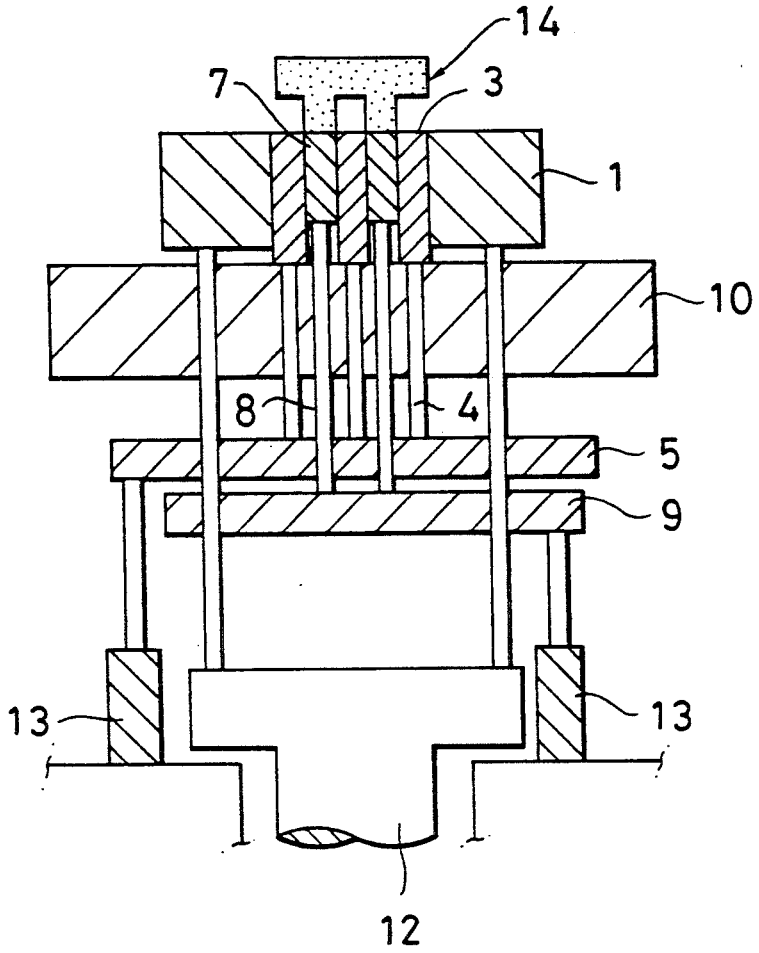
FIG. 3 is a cross-sectional view showing the press forming apparatus under a condition in which a compact has been so completed as to be withdrawn out of a die or mold.

In the press forming apparatus as described previously, powder that is a molding material or compound is filled, by a feeder, in a cavity which is defined by the die 1, the mold cavity 2 and the lower punch 7. In this case, the die 1 is located at an upper limit as shown in FIG. 1, and the lower punch 7 is fitted in the mold cavity 2. Thus, setting is made to a predetermined position. Subsequently, when the upper punch 6 arranged above the die 1 as shown in FIG. 2 is moved downwardly and the filled powder begins to be compacted, the die 1, and the divided core 3 and the lower punch 7 are moved downwardly, and the divided core 3 and the lower punch 7 are abutted against the stationary block 10. That is, such compacting mechanism is brought to a mechanism similar to a forming apparatus of withdrawal type. At this time, a compressive load is mainly received by the divided core 3 and the lower punch 7 on the stationary block 10, and it is possible to prevent an excessive load from being applied to the plurality of connecting rods 4 and 8. Ejection of the compact 14 after forming is such that the die 1 is moved further downwardly by the lower ram 12 as illustrated in FIG. 3. The lower punch 7 is moved upwardly after a flange of the compact 14 has projected from the die 1. The press forming apparatus constructed as described above prevents the mold cavity 2 defined by the divided core 3 and the lower punch 7 from being broken, by the presence or existence of the connecting rods 4 and 8 and the stationary block 10. This makes it possible that the compressive load is further enlarged so that there is produced the high density compact 14 which is free of cracks.

In connection with the above, the press forming apparatus is widely utilizable in forming of sintered parts which have a plurality of concentric irregularities such as, for example, a side plate of a compressor, in addition to the spiral sintered parts.

What is claimed is:

1. A press forming apparatus for manufacturing spiral sintered parts, said press forming apparatus comprising:

a die serving as an outer mold and having an opening at a center;

a divided core inserted into said opening, having a spiral mold cavity which extends vertically through said divided core;

an upper punch arranged above said die and movable vertically;

a lower punch arranged below said die, having a spiral configuration fitted in said mold cavity, cooperating with said die and said divided core to define a cavity into which powder is filled;

a plurality of first connecting rods extending in a press direction, arranged in a periphery direction of said divided core, being connected to a lower end of said divided core;

a core plate supporting lower ends of said plurality of first connecting rods, having through bores extending in the press direction;

a first vertical drive unit vertically driving said core plate;

a plurality of second connecting rods and extending in the press direction through the through bores in said core plate, being arranged in a spiral direction of said lower punch, being connected to a lower end of said lower punch;

a lower punch plate arranged below said core plate, supporting lower ends of the plurality of second connecting rods;

a second vertical drive unit vertically driving said lower punch plate; and a stationary block arranged between said die and said core plate, having a plurality of through bores through which said plurality of first and second connecting rods extend, restricting downward movement of said lower punch and said divided core.

* * * * *